US008002579B2

(12) United States Patent
Alrutz

(10) Patent No.: US 8,002,579 B2
(45) Date of Patent: Aug. 23, 2011

(54) COAXIAL CONNECTORS HAVING COMPRESSION RINGS THAT ARE PRE-INSTALLED AT THE FRONT OF THE CONNECTOR AND RELATED METHODS OF USING SUCH CONNECTORS

(75) Inventor: Mark Alrutz, Hickory, NC (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 12/619,781

(22) Filed: Nov. 17, 2009

(65) Prior Publication Data

US 2011/0117775 A1 May 19, 2011

(51) Int. Cl.
*H01R 9/05* (2006.01)

(52) U.S. Cl. ..... 439/578

(58) Field of Classification Search ..... 439/578, 439/583, 584; 29/876
See application file for complete search history.

(56) References Cited

U.S. PATENT DOCUMENTS

| | | | | | |
|---|---|---|---|---|---|
| 2,757,351 | A * | 7/1956 | Klostermann | 439/583 |
| 3,448,430 | A * | 6/1969 | Kelly | 439/607.52 |
| 4,035,089 | A * | 7/1977 | Schwartz et al. | 401/6 |
| 4,382,652 | A * | 5/1983 | Sinclair | 439/471 |
| 4,592,440 | A * | 6/1986 | Ujita et al. | 180/435 |
| 4,834,675 | A * | 5/1989 | Samchisen | 439/578 |
| 5,435,745 | A * | 7/1995 | Booth | 439/584 |
| 5,470,257 | A | 11/1995 | Szegda | |
| 5,662,489 | A * | 9/1997 | Stirling | 439/322 |
| 6,089,912 | A * | 7/2000 | Tallis et al. | 439/584 |
| 6,241,553 | B1 * | 6/2001 | Hsia | 439/578 |
| 6,530,807 | B2 | 3/2003 | Rodrigues et al. | |
| 6,767,247 | B2 * | 7/2004 | Rodrigues et al. | 439/578 |
| 6,767,249 | B1 * | 7/2004 | Li | 439/579 |
| 6,790,083 | B1 * | 9/2004 | Chen | 439/583 |
| D513,406 | S * | 1/2006 | Rodrigues et al. | D13/133 |
| 7,074,081 | B2 * | 7/2006 | Hsia | 439/584 |
| 7,144,273 | B1 * | 12/2006 | Chawgo | 439/583 |
| 7,153,161 | B2 * | 12/2006 | Huang | 439/583 |
| 7,192,308 | B2 | 3/2007 | Rodrigues et al. | |
| 7,500,874 | B2 * | 3/2009 | Montena | 439/587 |
| 7,544,094 | B1 * | 6/2009 | Paglia et al. | 439/585 |
| 7,740,502 | B2 * | 6/2010 | Blew et al. | 439/578 |
| 2002/0013088 | A1 * | 1/2002 | Rodrigues et al. | 439/578 |
| 2003/0162439 | A1 * | 8/2003 | Rodrigues et al. | 439/578 |
| 2004/0102089 | A1 * | 5/2004 | Chee | 439/578 |
| 2004/0229504 | A1 * | 11/2004 | Liu | 439/578 |
| 2005/0136735 | A1 * | 6/2005 | Rodrigues et al. | 439/578 |
| 2007/0123100 | A1 | 5/2007 | Rodrigues et al. | |
| 2008/0311790 | A1 * | 12/2008 | Malloy et al. | 439/583 |
| 2009/0033092 | A1 * | 2/2009 | Boyd | 285/330 |
| 2010/0081321 | A1 * | 4/2010 | Malloy et al. | 439/578 |
| 2010/0175253 | A1 * | 7/2010 | Blew et al. | 29/863 |

* cited by examiner

*Primary Examiner* — Tulsidas Patel
*Assistant Examiner* — Harshad Patel
(74) *Attorney, Agent, or Firm* — Myers Bigel Sibley & Sajovec

(57) ABSTRACT

Coaxial connectors include a connector body having a front end and a rear end, an inner contact post that is at least partly within the connector body and an internally-threaded nut that is positioned at the front end of the connector body and that is connected to at least one of the connector body and the inner contact post. A compression element is also provided that is attached to the internally-threaded rotatable nut.

7 Claims, 12 Drawing Sheets

COAXIAL CONNECTORS HAVING COMPRESSION RINGS THAT ARE PRE-INSTALLED AT THE FRONT OF THE CONNECTOR AND RELATED METHODS OF USING SUCH CONNECTORS

FIELD OF THE INVENTION

The present invention relates generally to communications systems and, more particularly, to connectors for coaxial cables.

BACKGROUND

Coaxial cables are a well-known type of electrical cable that may be used to carry information signals such as television or data signals. Coaxial cables are widely used in cable television networks and to provide broadband Internet connectivity. FIGS. 1A and 1B are, respectively, a transverse cross-sectional view and a longitudinal cross-sectional view of a conventional coaxial cable 10 (FIG. 1B is taken along the cross section 1B-1B shown in FIG. 1A). As shown in FIGS. 1A and 1B, the coaxial cable 10 has a central conductor 12 that is surrounded by a dielectric 14. A tape 16 is preferentially bonded to the dielectric 14. The central conductor 12, dielectric 14 and tape 16 comprise the core 18 of the cable. Electrical shielding wires 20 and, optionally, electrical shielding tape(s) 22 surround the cable core 18. Finally, a cable jacket 24 surrounds the electrical shielding wires 20 and electrical shielding tape(s) 22. As shown in FIG. 1B, the dielectric 14, tape 16, electrical shielding wires 20, electrical shielding tape 22 and cable jacket 24 may be cut, and the electrical shielding wires 20, electrical shielding tape 22 and cable jacket 24 may be folded back, in order to prepare the coaxial cable 10 for attachment to certain types of coaxial connectors.

Coaxial connectors are a known type of connector that may be used to connect two coaxial cables 10 or to connect a coaxial cable 10 to a female connector port on a device (e.g., a television, a cable modem, etc.) having a coaxial cable interface. Coaxial "F" connectors are one specific type of coaxial connector that is used to terminate a coaxial cable with a male coaxial connector.

A number of different types of coaxial "F" connector designs are known in the art, including, but not limited to, crimped connectors, swaged connectors and connectors which secure the cable into the connector with compression-style cable retention elements. With the crimped connector designs, typically a hexagonal-shaped tool is used to crimp a sleeve of the connector onto the coaxial cable that is to be terminated into the connector. With the swaged connector designs, the sleeve of the connector is swaged circumferentially inward so as to reduce its inside diameter in order to exert the required retention force on the coaxial cable.

SUMMARY

Pursuant to embodiments of the present invention, coaxial connectors are provided that include a connector body having a front end and a rear end, an inner contact post that is at least partly within the connector body, and an internally-threaded nut that is positioned at the front end of the connector body and that is connected to at least one of the connector body and the inner contact post. These connectors also include a compression element that is attached to the internally-threaded rotatable nut.

In some embodiments, the compression element is configured to be removed from the internally-threaded nut and mated with the rear end of the connector body. The compression element may comprise a compression sleeve. An external surface of the compression sleeve may include one or more threads that are configured to mate with the threaded portion of the internally-threaded nut. The compression sleeve may have a first end that has a first diameter and a second end that has a second diameter that is smaller than the first diameter, and the threads may be located at the second end of the compression sleeve.

In some embodiments, the external surface of the compression sleeve may include one or more split annular rings instead of, for example, threads. In other embodiments, the compression sleeve may be adhesively bonded to the internally-threaded nut. In still other embodiments, the compression sleeve may be attached to the internally-threaded nut using an adhesive tape or stretch wrap. In yet additional embodiments, the connector may include a port seal that is mounted to extend from the internally-threaded nut, and the compression sleeve may be attached to the internally-threaded nut by being friction fit within the port seal. In yet further embodiments, the connector may further include a disposable compression sleeve attachment element that is configured to attach the compression sleeve to the internally-threaded nut.

Pursuant to further embodiments of the present invention, methods of installing a coaxial connector that has a front end and a rear end onto an end of a coaxial cable are provided. The coaxial connectors used in these methods may include a connector body, an inner contact post that is at least partly within the connector body, a rotatable nut that is attached adjacent the front end of the connector body and a compression sleeve that is removably attached to extend away from a front end of the rotatable nut. Pursuant to these methods, the compression sleeve is first detached from the remainder of the connector. Then the compression sleeve is placed over the end of the coaxial cable. The end of the coaxial cable is inserted into the rear end of the coaxial connector. Then, the compression sleeve is fully seated within connector body so as to impart a compressive force on the coaxial cable.

In some embodiments, the coaxial connector may be delivered from the factory with the compression sleeve directly mounted to the rotatable nut. In such embodiments, the compression sleeve may be attached to the rotatable nut via, for example, a threaded or split annular ring connection, an adhesive bond, an adhesive tape and/or a stretch wrap. In other embodiments, the coaxial connector may be delivered from the factory with the compression sleeve indirectly mounted to the rotatable nut. In such embodiments, the compression sleeve may be attached to the rotatable nut via, for example, a port seal that is mounted to extend from the front end of the rotatable nut or a disposable compression sleeve attachment element.

DETAILED DESCRIPTION

Figure 1A:
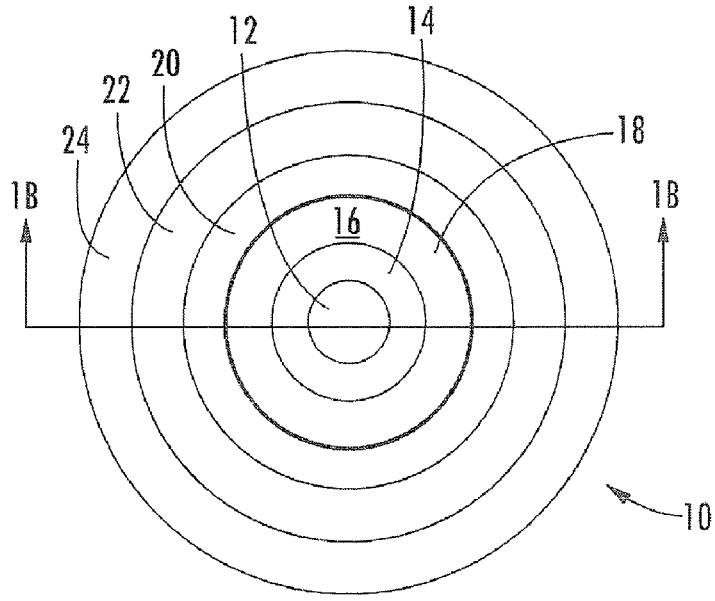
FIG. 1A (PRIOR ART)
FIGS. 1A and 1B are, respectively, a transverse cross-sectional diagram and a longitudinal cross-sectional diagram of a conventional coaxial cable.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the drawings, the size of lines and elements may be exaggerated for clarity. It will also be understood that when an element is referred to as being "coupled" to another element, it can be coupled directly to the other element, or intervening elements may also be present. In contrast, when an element is referred to as being "directly coupled" to another element, there are no intervening elements present. Likewise, it will be understood that when an element is referred to as being "connected" or "attached" to another element, it can be directly connected or attached to the other element or intervening elements may also be present. In contrast, when an element is referred to as being "directly connected" or "directly attached" to another element, there are no intervening elements present. The terms "upwardly", "downwardly", "front", "rear" and the like are used herein for the purpose of explanation only.

This invention is directed to coaxial connectors, with a primary example of such being an coaxial "F" connector. As used herein, the term "longitudinal" and derivatives thereof refer to the direction defined by the central axis of the coaxial connector, which is generally coexistent with the central axis of any coaxial cable that the coaxial connector is installed on. The term "transverse" and derivatives thereof refer to the plane that is normal to the longitudinal direction. Herein, the terms "front", "front end" and derivatives thereof when used with respect to a coaxial connector refer to the end of the coaxial connector that mates with another coaxial connector such as, for example, a coaxial port on a television set, cable modem or the like. Thus, the "front" or "front end" of an F-style coaxial connector refers to the end of the connector that includes a nut that is configured to be threaded onto a mating female coaxial port. Likewise, references herein to the "rear" or "rear end" of a coaxial connector refer to the end of the coaxial connector that is opposite the front end that receives a coaxial cable.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. As used herein, the term "and/or" includes any and all combinations of one or more of the associated listed items.

Coaxial "F" connectors that include compression sleeves (also referred to as "compression rings") have been available for many years in many different package forms. Early coaxial connectors were delivered as two-piece connectors. The first piece included the connector body, inner contact post and nut. The compression sleeve was provided as a separate second piece. However, these two-piece coaxial F connectors had a distinct disadvantage in that the separate compression sleeve was often lost in the field. Other early coaxial F connectors such as, for example, the connectors shown in U.S. Pat. No. 4,834,675 to Samchisen ("the '675 patent"), delivered the connectors as a single piece connector, with the compression sleeve attached by a thin web of plastic to a plastic ring that encircled the connector body. An installer removed the compression sleeve by manipulating it a few times to break the thin plastic web, and the compression sleeve could then be placed over the end of a coaxial cable on which the connector was to be installed. While the connectors of the '675 patent were delivered as one-piece connectors, in practice, the compression sleeve often became detached from the connector body prior to installation, thus making it more difficult for cable installers to find both pieces of the connector in the field.

Thereafter, coaxial F connectors were developed in which the compression sleeve was integrated into the rear end of the connector body at the factory, and delivered as a one-piece connector. An example of such a connector is disclosed in U.S. Pat. No. 5,470,257 to Szegda ("the '257 patent"). As discussed in the '257 patent, pre-installing the compression ring in the rear end of the connector overcame the above-mentioned problems with earlier coaxial connectors. In the design of the '257 patent, the compression sleeve may move between an unseated position within the connector body which allows for installation of a coaxial cable into the connector body, and a seated position where the compression sleeve locks the coaxial cable into place within the connector body. In these coaxial connector designs, the connector is shipped from the factory with the compression sleeve in its unseated position, and an installer in the field then uses a compression tool to move the compression sleeve into its seated position after the coaxial cable has been inserted into the connector body.

In still more recent designs, the coaxial connectors include a compression sleeve that is integrated into the rear end of the connector body at the factory and delivered as a one-piece connector, but the compression sleeve is designed so that it can be subsequently detached by an installer. An example of such a connector is disclosed in U.S. Pat. No. 6,530,807 to Rodrigues ("the '807 patent"). After detaching the compression sleeve from the connector body, the installer may place the compression sleeve over the coaxial cable and move it away from the end of the cable (so that it is out of the way), and then insert the end of the coaxial cable into the connector body. As the compression sleeve is spaced apart from the connector during the cable insertion process, the installer may more easily insert the cable into the connector at the proper angle and make sure that the cable is properly seated over the inner contact post. The compression sleeve can then be slid along the coaxial cable until it contacts the connector body, at which point the installer may reattach the compression sleeve to the connector body and then use a compression tool to seat the compression sleeve and thereby lock the coaxial cable into place within the connector body.

Each of the above coaxial connectors may have various disadvantages. The older two piece coaxial connectors and the coaxial connectors according to the '257 patent often resulted in lost or hard-to-find compression sleeves. The connectors having the compression sleeve pre-installed into the rear end of the connector body overcome the potential problems of lost or hard-to-find compression sleeves, but force installers to insert the coaxial cable into the connector body while the compression sleeve is in place. As a result, with these one-piece connectors it is often more difficult for the installer to make sure that the cable is being inserted at the correct angle and/or that the cable has been firmly seated over the inner contact post due to the "blind entry" that necessarily results if the cable is inserted into the connector body while the compression sleeve is in place. As a result, the dielectric tape of the coaxial cable can catch on the inner contact post and be torn due to the insertion of the cable at an angle relative to the inner contact post. Additionally, when the coaxial cable is blindly inserted within the connector (as the compression sleeve blocks the installer's view into the connector), the folded braiding and/or tape of the coaxial cable may not be properly seated inside the connector, which can lead to water migration or other problems. Moreover, when the compression sleeve is in place, a higher force must be applied when inserting the coaxial cable into the connector body, and the application of this increased force may increase the possibility that either the cable or the connector is damaged during the cable insertion process.

The coaxial connectors having a pre-installed compression sleeve that may be snapped out by the customer may alleviate the issues associated with both lost connector pieces and blind entry insertion. However, in practice, installers may be unaware that the compression sleeve is detachable and/or may not take the additional time to detach the compression sleeve from the connector body, and hence the installers may not take advantage of the fact that the compression sleeve is detachable. Consequently, damaged cables and connectors and/or poor connections may also be obtained when these coaxial connectors are used.

Pursuant to embodiments of the present invention, coaxial "F" connectors with compression-style back fittings are provided where the compression sleeve is firmly, but removably, pre-installed at the factory into the front end of the connector. Thus, the connector is delivered as a one-piece connector, and the connectors according to embodiments of the present invention may stay as one-piece connectors and may not become tangled with other connectors when placed in an installer's bag in the field. Moreover, since the compression sleeve is pre-installed into the front end of the connector, an installer in the field must necessarily fully detach the compression sleeve from the connector body before a coaxial cable is installed within the connector. Thus, installers can never avoid the step of detaching the coaxial cable, and thus the coaxial connectors according to embodiments of the present invention will avoid the "blind entry" problem in practice, as once an installer has detached the compression sleeve, it is most efficient for the installer to insert the cable into the connector body with the compression sleeve spaced apart from the connector body, and only re-attach the compression sleeve once the cable has been mounted on the inner contact post. Thus, the coaxial connectors according to embodiments of the present invention may be easy to use and may avoid the concerns associated with blind entry installations (i.e., increased risk of damage due to misalignment and/or increased insertion force and increased probability of a poor connection due to reduced visibility).

Figure 2:
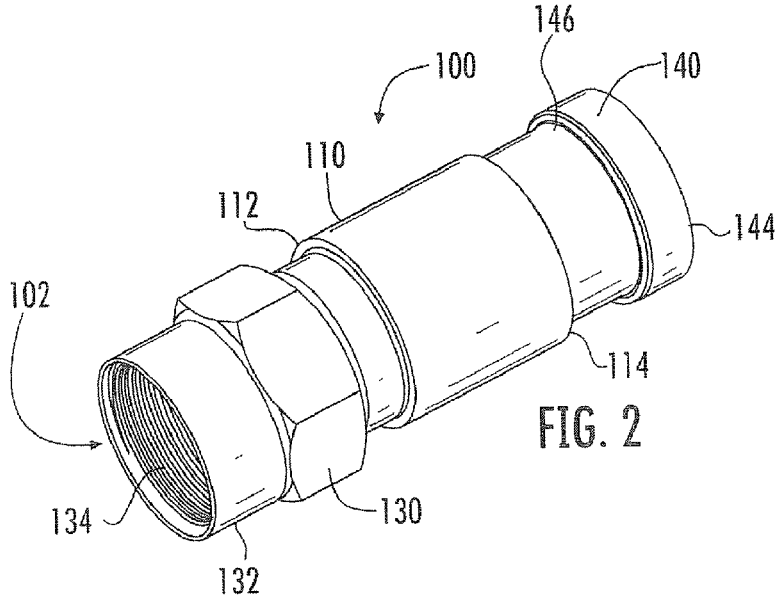
FIG. 2 is a perspective view of a coaxial "F" connector according to embodiments of the present invention.
Figure 3:
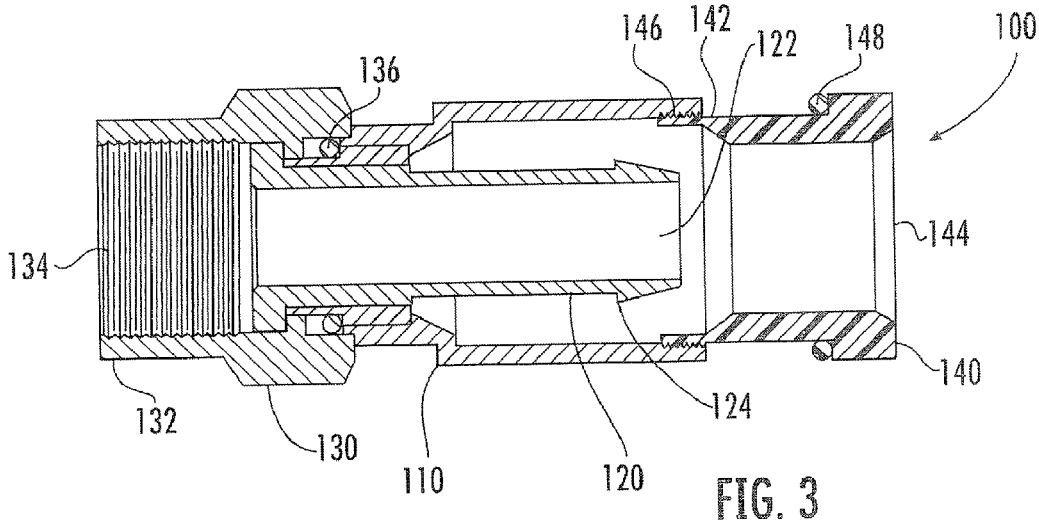
FIG. 3 is a side cross-sectional view of the coaxial "F" connector of FIG. 2 taken along the line 3-3 of FIG. 2.
Figure 4:
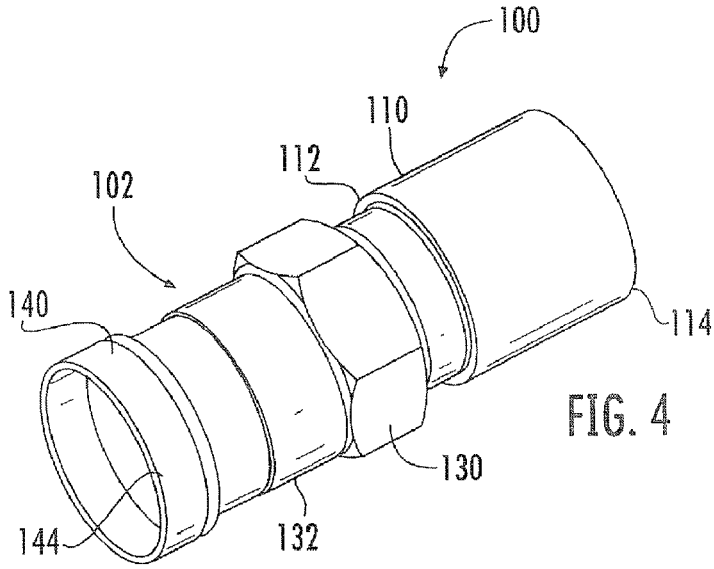
FIG. 4 is a perspective view of a coaxial "F" connector of FIG. 2 illustrating how the compression sleeve may be pre-installed at the front of the connector.

FIG. 2 is a perspective view of a coaxial "F" connector 100 according to embodiments of the present invention, with the compression sleeve inserted into the rear of the connector and set in its unseated position. FIG. 3 is a cross-sectional view of the connector 100 taken along the line 3-3 of FIG. 2. FIG. 4 is a perspective view of the connector 100 illustrating how the compression sleeve may be pre-installed at the front of the connector at the factory.

As shown in FIGS. 2-4, the connector 100 includes a tubular connector body 110 that has a front end 112 and a rear end 114, an inner contact post 120, an internally threaded nut 130 and a compression sleeve 140. The connector body 110 may comprise a generally cylindrical body piece having an open interior. The outer and/or inner diameter of the connector body 110 may vary along the length of the connector body 110. The connector body 110 may be formed, for example, of brass or steel or another metal or metal alloy.

The internally threaded nut 130 may comprise a brass or steel nut having an exterior surface that has a hexagonal transverse cross-section. The nut 130 may include a lip 132 that has an exterior surface that has a non-hexagonal cross-section such as, for example, a circular transverse cross-section. The internally threaded nut 130 is mounted adjacent the front end 112 of the connector body 110. The interior surface of the end of the nut 130 that is opposite the connector body 110 includes a plurality of threads 134. An O-ring, gasket or other member 136 (see FIG. 3) may be positioned between the internally threaded nut 130 and the connector body 110 to reduce or prevent water or moisture ingress into the interior of the connector 100.

As shown in FIG. 3, the inner contact post 120 is mounted within both the connector body 110 and the internally threaded nut 130. The inner contact post 120 has an open end 122 that extends toward the rear end 114 of the connector body 110. As shown in FIG. 3, the inner contact post 120 may be used to connect the internally threaded nut 130 to the connector body 110, and may facilitate mounting the nut 130 to the connector body 110 so that the nut 130 may be freely rotated independent of the connector body 110. The outside surface of the inner contact post 120 may include one or more serrations, teeth, lips or other structures 124. The inner contact post 120 may comprise, for example, a brass or steel post.

The compression sleeve 140 may comprise a hollow cylindrical body having a first end 142 and a second end 144. The compression sleeve 140 is typically formed of a plastic material, but may also be formed of other materials such as brass, rubber or the like. The first end 142 of the compression sleeve 140 may have a first external diameter that is less than a second external diameter of the second end 144. A gasket or O-ring 148 (see FIG. 3) may be mounted on the exterior surface of the compression sleeve 140. In some embodiments, the gasket 148 may be mounted at the point where the diameter of the exterior surface transitions from the first external diameter to the second external diameter. As shown in FIG. 3, the inner diameter of the first end 142 of the compression sleeve 140 may be greater than the inner diameter of the second end 144 of the compression sleeve 140. A ramped transition section may connect the inner radii of the first end 142 and second end 144 of the compression sleeve 140.

As shown in FIG. 4, at the time of manufacture, the compression sleeve 140 may be mounted adjacent the front end 112 of the connector body 110. In particular, as can be seen from FIG. 3, the exterior surface of the first end 142 of the compression sleeve 140 may include two or more external threads 146. These external threads 146 are sized to mate with the threads 134 of the internally-threaded nut 130. Thus, the compression sleeve 140 may be attached to the connector 100 at the factory by inserting the compression sleeve 140 into the threaded end of the internally threaded nut 130 and rotating the compression sleeve 140 relative to the nut 130 to mate the external threads 146 of the compression sleeve with the internal threads 134 of the nut 130. In this fashion, the connector 100 may be shipped from the factory in a single piece with the compression sleeve mounted in a front end 102 of the connector 100.

Figure 5:
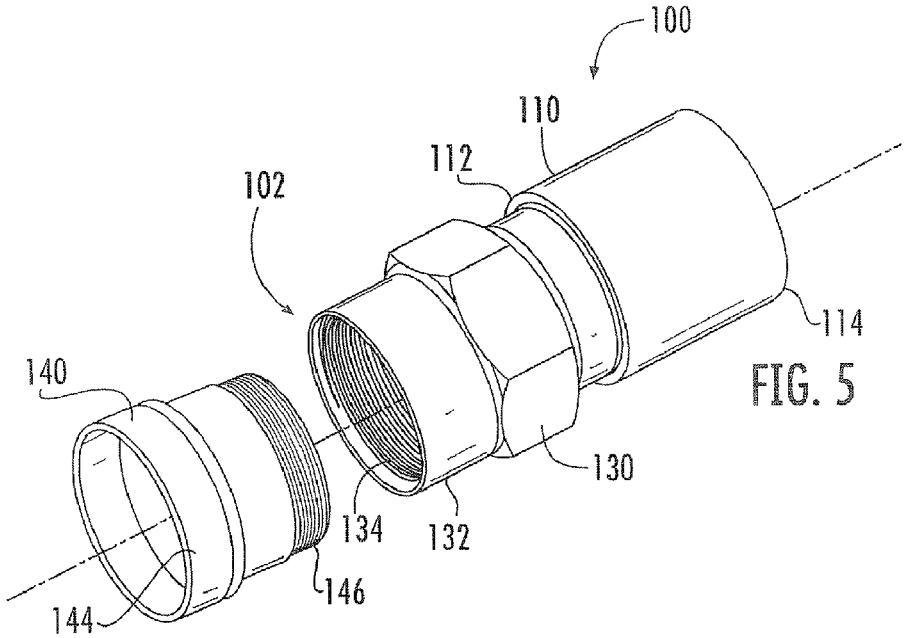
FIGS. 5-9 are perspective views illustrating how the coaxial connector of FIGS. 2-4 may be attached to the end of a coaxial cable.
Figure 6:
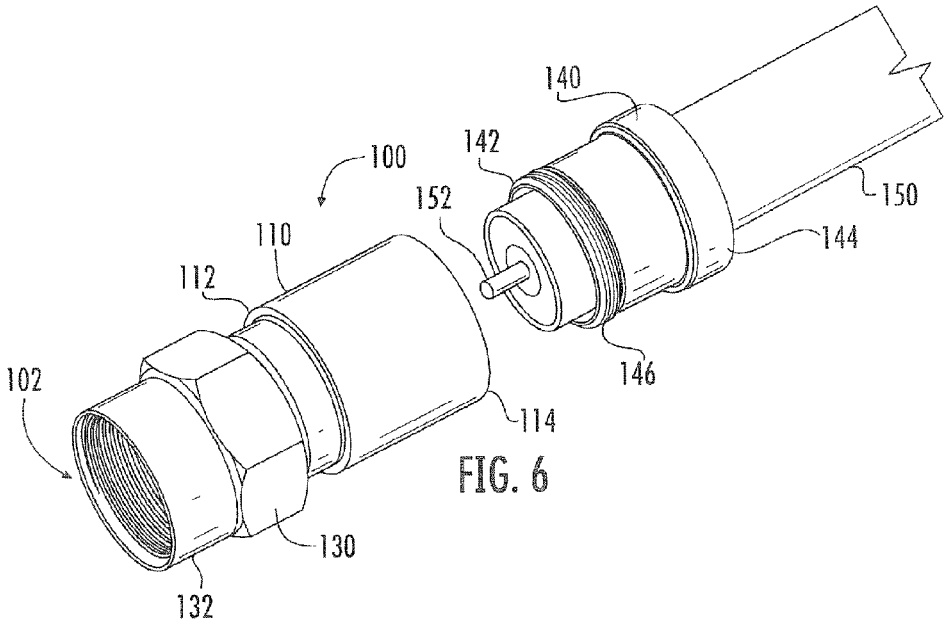
Figure 7:
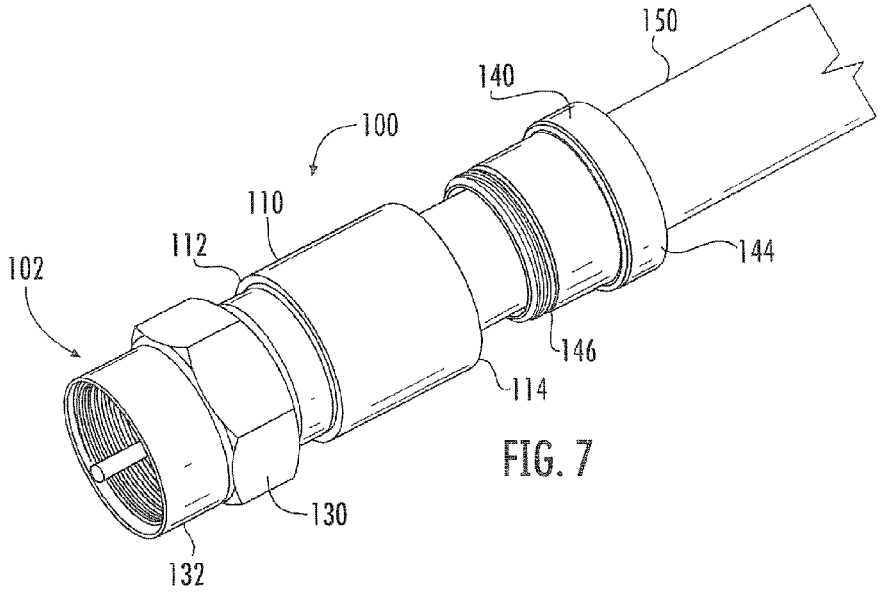
Figure 8:
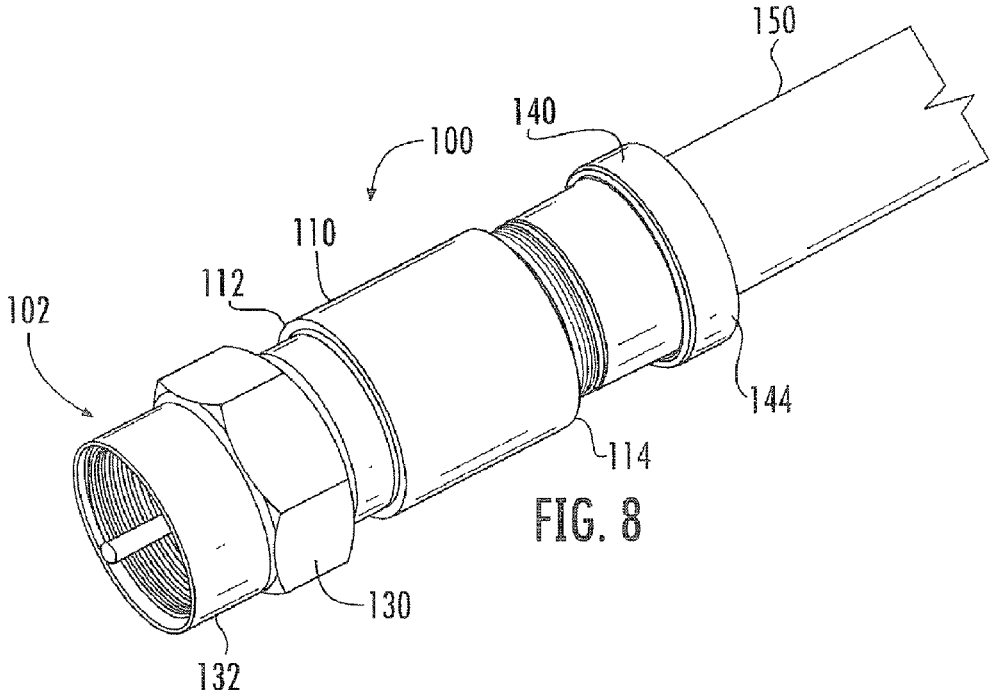
Figure 9:
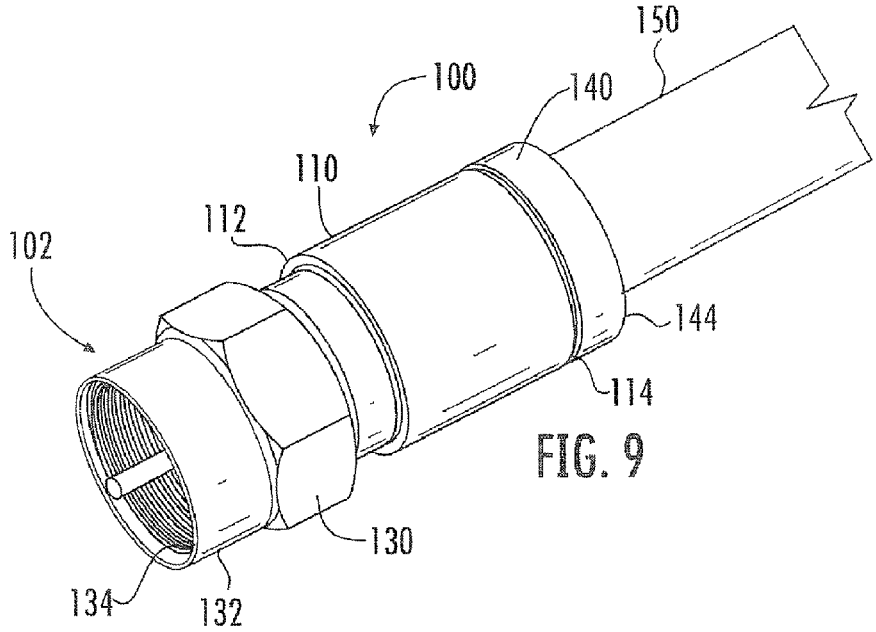

FIGS. 5-9 illustrate how the coaxial connector 100 of FIGS. 2-4 may be used to terminate a coaxial cable 150. In particular, FIG. 5 is a perspective view of the coaxial connector 100 with the compression sleeve 140 detached from its factory pre-installed position in the front of the connector. FIG. 6 is a perspective view of the connector 100 that illustrates how the detached compression sleeve 140 can be placed over the end of the coaxial cable 150. FIG. 7 is a perspective view that illustrates how the end of the coaxial cable 150 having the compression sleeve 140 thereon may be inserted into the connector 100. FIG. 8 is a perspective view that illustrates how the compression sleeve 140 may then be reattached to the connector 100 in its unseated position. FIG. 9 is a perspective view illustrating how the reattached compression sleeve 140 may then be moved into its seated position to lock the coaxial cable 150 in place within the connector 100.

As shown in FIG. 5, to install the connector 100 onto the end of a coaxial cable 150, the compression sleeve 140 is first detached from its factory pre-installed position on the front 102 of the connector 100. This may be accomplished, for example, by the installer rotating the compression sleeve 140 relative to the nut 130 to unscrew the compression sleeve 140 from the nut 130.

Figure 1B:
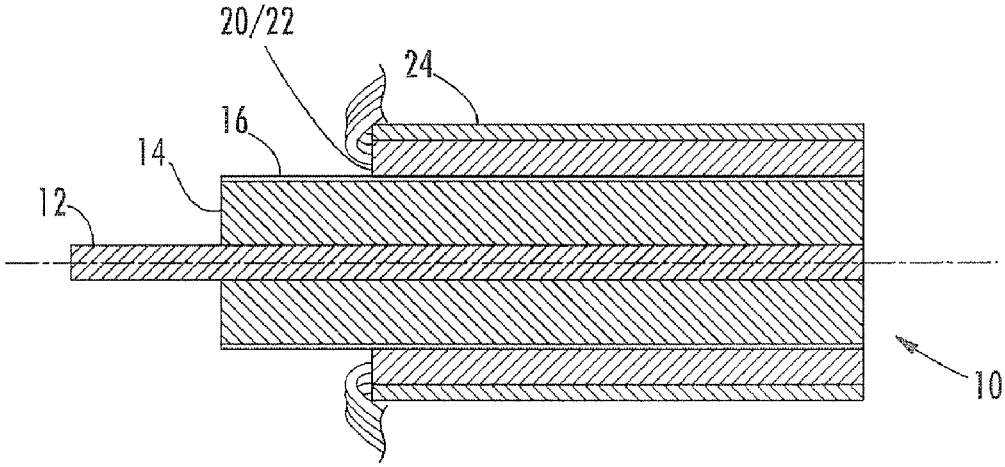
FIG. 1B (PRIOR ART)

Next, the cable 150 may be prepared as shown in FIG. 1B. Then, as shown in FIG. 6, the detached compression sleeve 140 may be placed over the free end 152 of the cable 150. The first end 142 of the compression sleeve 140 (i.e., the end having the narrower external diameter) is positioned closest to the free end 152 of the cable 150. The compression sleeve 140, however, is moved a distance away from the free end 152 of cable 150 so that the compression sleeve will not obstruct the installer's view of the free end 152 of the cable 150 when the cable 150 is inserted into the connector 100 in a subsequent operation.

Next, as shown in FIG. 7, the prepared free end 152 of the coaxial cable 150 may be axially inserted into the inside diameter of the rear end 114 of the connector body 110. The core of the coaxial cable 150 is inserted axially into an inside diameter of the inner contact post 120, while the electrical shielding wires/tape and the cable jacket are inserted to circumferentially surround the outer surface of inner contact post 120. The free end 152 of the coaxial cable 150 is inserted as far as it will go into the connector body 110 so that the central conductor of the cable 150 extends all the way through the inner contact post 120 into the threaded portion 134 of the internally threaded nut 130. Notably, as the compression sleeve 140 is positioned detached from the connector 100 and pushed at least a short distance down the coaxial cable 150, the compression sleeve 140 does not obstruct the installer's view into the interior of the connector 100 when the cable 150 is inserted within the connector body 110. As is discussed in greater detail below, this may make it easier for the installer to correctly align the cable 150 with the inner contact post 120 and the connector body 110.

Next, as shown FIG. 8, the compression sleeve 140 may then be reattached to the connector 100. This may be accomplished by simply sliding the compression sleeve 140 toward the free end 152 of the cable 150 until the compression sleeve 140 comes into contact with the rear end 114 of the connector body 110. The compression sleeve 140 is then axially inserted into the connector body 110 so as to circumferentially surround an upper portion 152 of the inner contact post 150. In FIG. 8, the compression sleeve 140 has been reattached to the connector body 110, but is in its unseated position and hence does not act to lock the coaxial cable 150 in place inside the connector 100.

As shown in FIG. 9, the compression sleeve may then be moved into its seated position, typically by using a compression tool. As can best be seen with reference to FIG. 3, as the first end 142 of the compression sleeve 140 (the end with the reduced internal diameter) enters into the rear end 114 of the connector body 110, the radial gap between the inside diameter of the compression sleeve 140 and inner contact post 120 is reduced so as to radially impart a 360-degree circumferential compression force on the electrical shielding wires/tape and the cable jacket of the coaxial cable 150, thereby pressing the shielding wires/tape and the cable jacket against the outer surface of inner contact post 120. Once the compression sleeve 140 is fully inserted into its seated position, this compressive force, in conjunction with the serrations, teeth or the like 124 on the outside surface of the inner contact post 120, result in a gripping or retention force that is applied to the coaxial cable 150 that meets SCTE requirements for connector pull-off as well as additional electrical, mechanical and environmental requirements. In addition, this gripping/retention force may also contribute toward a positive moisture seal at the cable-connector interface.

The coaxial connectors according to embodiments of the present invention may offer several advantages over conventional coaxial cables. For example, as an installer must necessarily detach the compression sleeve from the connector during the installation process, the connectors according to embodiments of the present invention remove the incentives that an installer may otherwise have to insert the free end of a cable into the connector while the compression sleeve is in its unseated position at the rear of the connector body. Thus, the connectors according to embodiments of the present invention can avoid the "blind entry" problem, which means that the connectors should be properly installed onto a cable a greater percentage of the time. A significant percentage of F-style coaxial connector installations (e.g., as many as 10% or more) may be performed improperly, particularly when the connectors are used to terminate heavily shielded cables such as quad cables. Since improper installations can result in additional service trips by, for example, a cable television provider to subscriber premises, reducing the number of improper installations can result in significant monetary savings.

Additionally, since the free end of the coaxial cable will almost always be inserted into the connector body when the compression sleeve is detached from the connector, the cable can be positioned inside the connector body with the application of less force. This can reduce the number of connectors that are damaged during the installation process. Moreover, by pre-mounting the compression sleeve at the factory so that it projects from the front of the connector, the connectors according to embodiments of the present invention have a generally tubular shape, in contrast to the prior art connectors shown, for example, in the above-described '257 patent. These prior art connectors, when stored loosely in a pouch, bag or box as is typically the case, are prone to become hooked or tangled with other connectors, which can make it more difficult for an installer to quickly pull a single connector out of the storage pouch. Additionally, the force exerted by an installer to segregate tangled connectors can, in practice, be sufficient to rip the compression sleeve off of the prior art connectors of the '257 patent, leading to lost compression sleeves. In contrast, the generally tubular connectors according to embodiments of the present invention should not easily become tangled with each other, making it easier for an installer to quickly and easily pull a single connector out of a storage bag, pouch or box.

Figure 10:
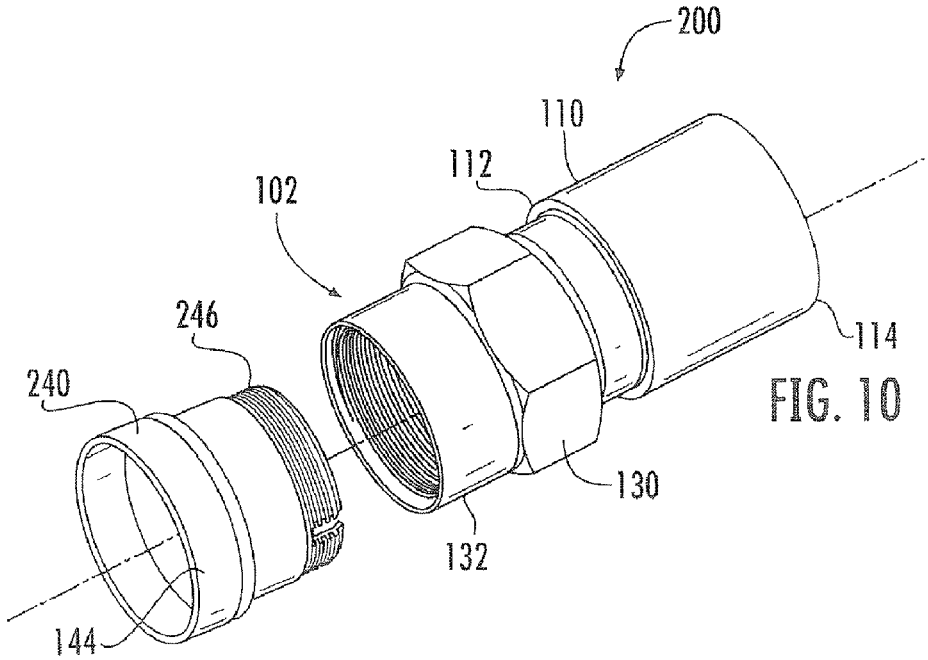
FIG. 10 is an exploded perspective view of a coaxial "F" connector according to further embodiments of the present invention.

FIG. 10 is an exploded perspective view of an F-style coaxial connector 200 according to further embodiments of the present invention. The connector 200 may include a connector body 110, an internal contact post 120 and an internally-threaded nut 130, each of which may have the same configuration as the correspondingly numbered elements of the connector 100 described above with respect to FIGS. 2-9. As shown in FIG. 10, the connector 200 further includes a compression sleeve 240. The compression sleeve 240 may be identical to the compression sleeve 140 of FIGS. 2-9, except that the external threads 146 of compression sleeve 140 are replaced with split annular rings 246 that are configured to either thread into the internal threads 134 of nut 130 or to snap-engage with the internal threads 134 of nut 130. As with the connector 100 described above, the connector 200 may be delivered from the factory with the compression sleeve 240 threaded or snap-engaged with the internally threaded nut 130 so that the compression sleeve 240 is mounted on the front end 102 of the connector 200. When an installer is ready to install the connector 200 onto the end of a coaxial cable 150, the compression sleeve 240 is detached from the nut 130 (either by unscrewing the compression sleeve 240 or by application of an axial force that pops the split annular rings 246 out of the threads 134 of the nut 130) and slid onto the coaxial cable 150. The free end 152 of the coaxial cable 150 is then inserted into the rear end 114 of the connector body 110. Further description of this installation process will not be provided herein as once the compression sleeve 240 is detached from the connector 200, the installation process may be identical to the installation process described above for connector 100 with respect to FIGS. 6-9.

Figure 11:
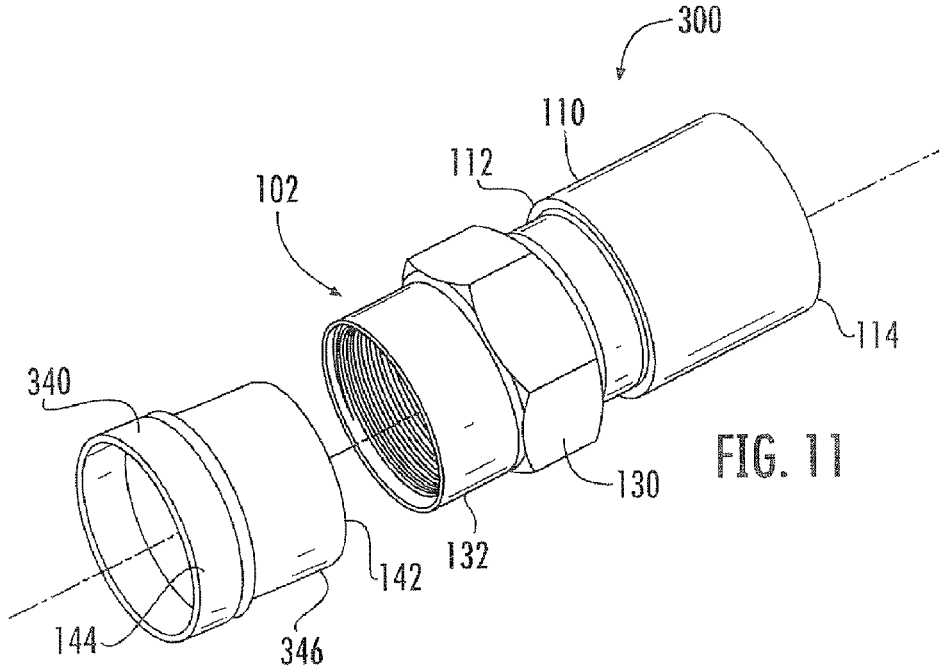
FIG. 11 is an exploded perspective view of a coaxial "F" connector according to still further embodiments of the present invention.

FIG. 11 is an exploded perspective view of an F-style coaxial connector 300 according to still further embodiments of the present invention. The connector 300 may include a connector body 110, an internal contact post 120 and an internally-threaded nut 130, each of which may have the same configuration as the correspondingly numbered elements of the connector 100 described above with respect to FIGS. 2-9. As shown in FIG. 11, the connector 300 further includes a compression sleeve 340. The compression sleeve 340 may be identical to the compression sleeve 140 of FIGS. 2-9, except that the external threads 146 are not provided, and instead an external surface 346 of a first end 142 of the compression sleeve 340 may have, for example, a smooth surface and a circular transverse cross-section. The connector 300 may be delivered from the factory with the first end 142 of the compression sleeve 340 bonded into the interior of the internally threaded nut 130 using, for example, an adhesive. When an installer is ready to install the connector 300 onto the end of a coaxial cable 150, the installer may twist the compression sleeve 340 relative to the nut 130 in order to break the adhesive bond and thereby detach the compression sleeve 340 from the connector 300. The connector 300 may then be installed on the end of a coaxial cable 150 in the manner described above for connector 100 with respect to FIGS. 6-9.

Figure 12A:
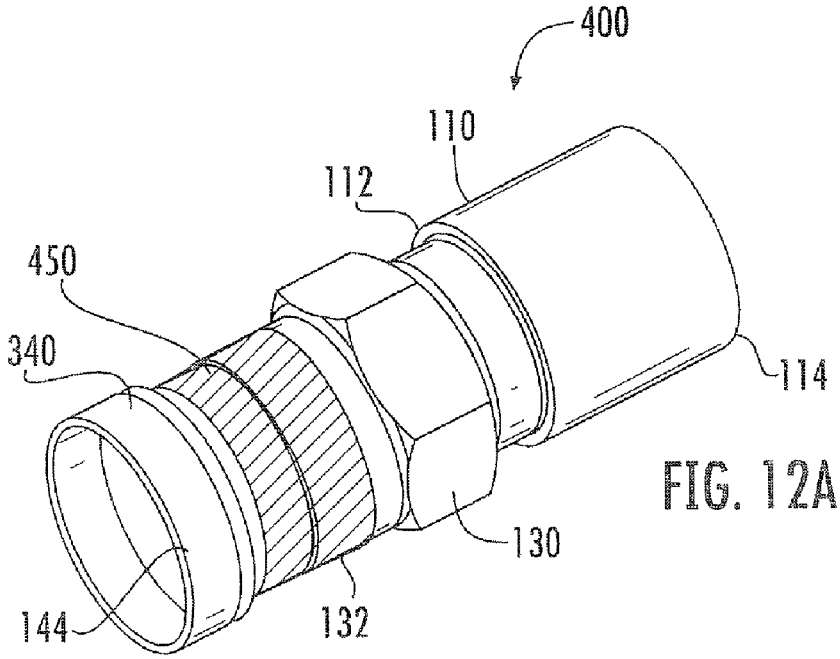
FIGS. 12A and 12B are perspective views of F-style coaxial connectors according to still further embodiments of the present invention.
Figure 12B:
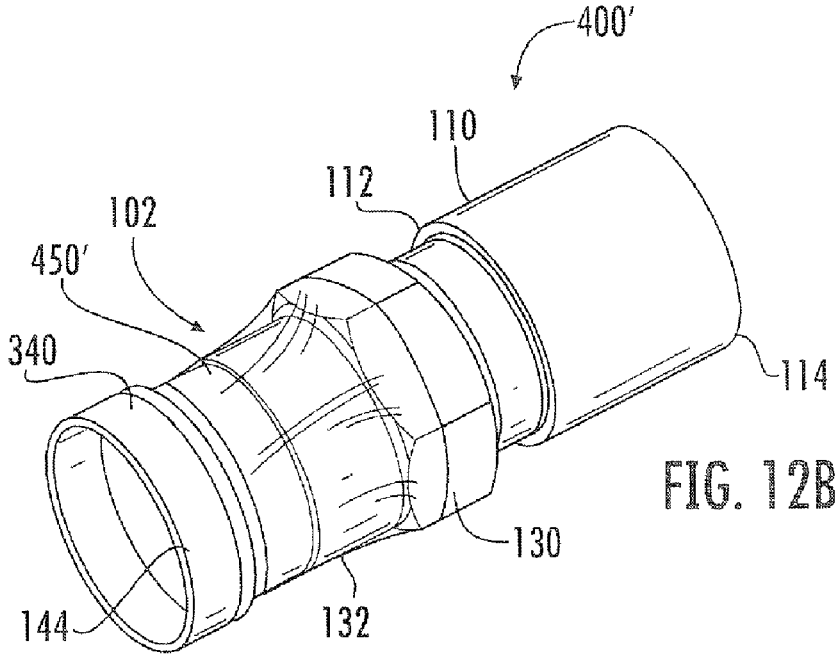

FIGS. 12A and 12B are exploded perspective views of F-style coaxial connectors 400 and 400', respectively, according to still further embodiments of the present invention. The connectors 400 and 400' may be identical to the connector 300 described above with respect to FIG. 11, except that the adhesive that is used with the connector 300 to bond the compression sleeve 340 to the internally-threaded nut 130 is omitted, and instead in the connector 400 an adhesive tape 450 (see FIG. 12A) is provided that is used to tape the compression sleeve 340 to the internally-threaded nut 130, and in the connector 400', a stretch wrap 450' (see FIG. 12B) is provided that is used to hold the first (narrow) end of the compression sleeve 450' within the internally-threaded nut 130. The connectors 400 and 400' may be delivered from the factory with the first ends 142 of the compression sleeve 340 of each connector inserted and held within the internally-threaded nut 130 by the adhesive tape 450 or shrink wrap 450'. When an installer is ready to install the connector 400 or the connector 400' onto the end of a coaxial cable 150, the installer may remove the adhesive tape 450 or the shrink wrap 450' to detach the compression sleeve 340 from the connector 400 or the connector 400'. The connector 400 or 400' may then be installed on the end of a coaxial cable 150 in the manner described above with respect to FIGS. 6-9.

Figure 13A:
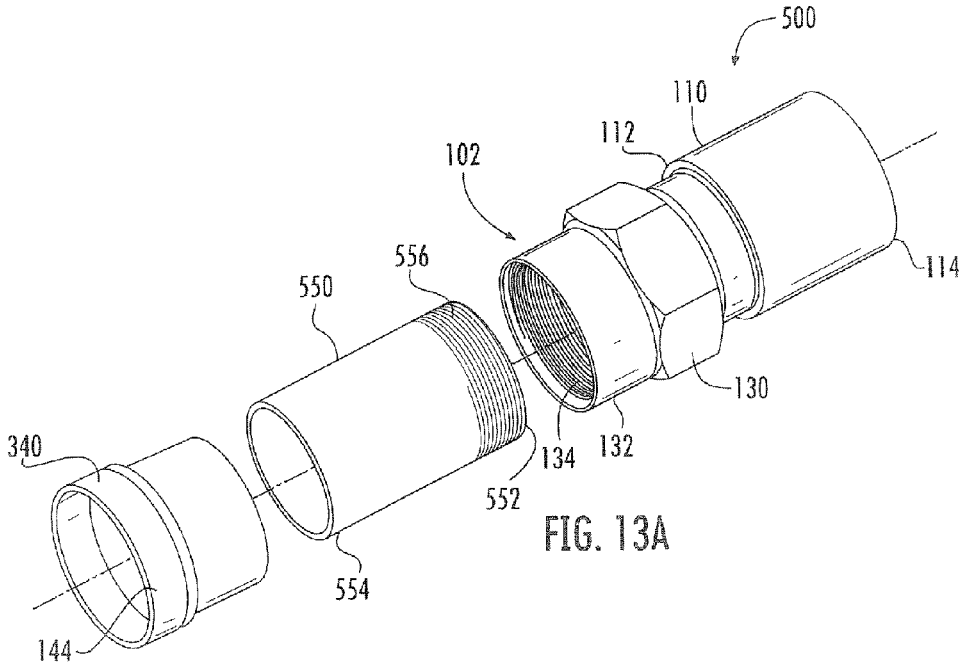
FIGS. 13A and 13B are perspective views of F-style coaxial connectors according to additional embodiments of the present invention.

FIG. 13A is an exploded perspective view of an F-style coaxial connector 500 according to still further embodiments of the present invention. The connector 500 may include a connector body 110, an internal contact post 120 and an internally-threaded nut 130, each of which may have the same configuration as the correspondingly numbered elements of the connector 100 described above with respect to FIGS. 2-9. As shown in FIG. 13A, the connector 500 further includes a compression sleeve 340, which may, for example, be identical to the correspondingly numbered element described above with respect to FIGS. 11, 12A and 12B. Additionally, the connector 500 further includes a disposable compression sleeve attachment element 550. In the embodiment of FIG. 13A, the disposable compression sleeve attachment element 550 comprises a generally cylindrical element that has a first end 552 and a second end 554. A plurality of threads 556 are provided on an external surface of the first end 552. These threads 556 are sized and configured to mate with the threads 134 of the internally-threaded nut 130. The length of the disposable compression sleeve attachment element 550 is such that when the first end of the disposable compression sleeve attachment element 550 is threaded into the nut 130, the second end 554 extends beyond the nut 130. The external diameter of the second end 554 of the disposable compression sleeve attachment element 550 may be sized to friction fit within an internal surface of the compression sleeve 340. At the factory, the first end 552 of the disposable compression sleeve attachment element 550 may be threaded into the nut 130, and the compression sleeve 340 may be mounted via a friction fit onto the second end 554 of the disposable compression sleeve attachment element 550. When an installer is ready to install the connector 500 onto the end of a coaxial cable 150, the installer may simply unscrew the disposable compression sleeve attachment element 550 from the internally-threaded nut 130 and pull the disposable compression sleeve attachment element 550 out of the compression sleeve 340. The disposable compression sleeve attachment element 550 may then be thrown away. The connector 500 may then be installed onto the end of a coaxial cable 150 in the manner described above with respect to FIGS. 6-9.

Figure 13B:
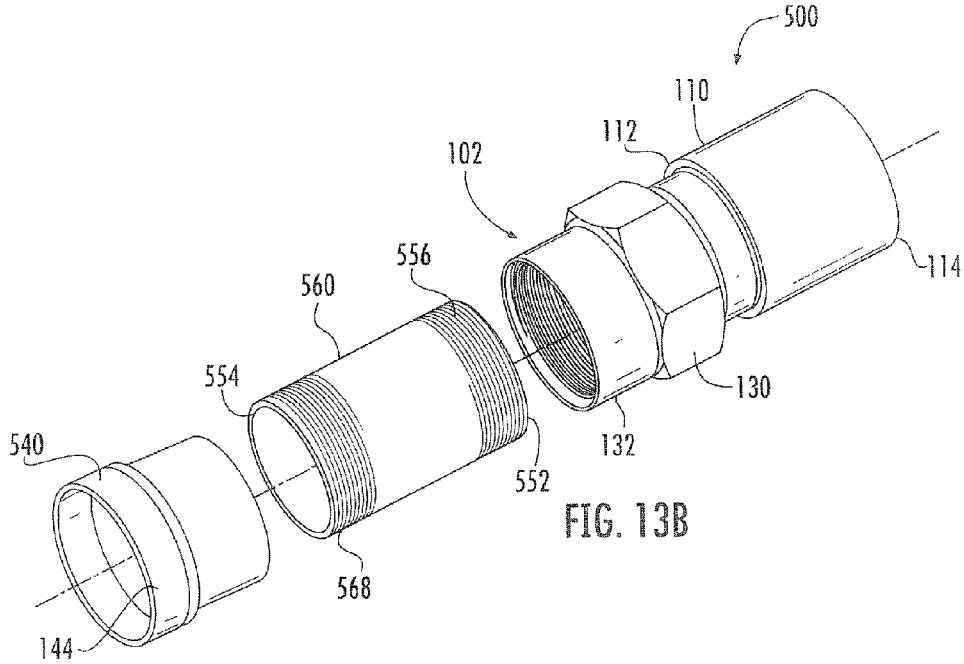

It will be appreciated that numerous other disposable compression sleeve attachment elements could be used. For example, as shown in FIG. 13B, in an alternative embodiment, a disposable compression sleeve attachment element 560 could be provided that includes a first set of external threads 566 that may be identical to the threads 556 on disposable compression sleeve attachment element 550 described above, as well as a second set of external threads 568 that are provided on the second end 554 of the disposable compression sleeve attachment element 560. Additionally, in place of the compression sleeve 340, a compression sleeve 540 could be provided that includes a set of internal threads (not visible in FIG. 13B) that mate with the second set of external threads 568 on the disposable compression sleeve attachment element 560. As a result, the disposable compression sleeve attachment element 560 may be mated with both the internally-threaded nut 130 and the compression sleeve 540 by a threaded attachment, which may provide a more robust connection than the friction fit attachment used with the connector 500 of FIG. 13A described above and/or which may make detachment of the compression sleeve easier. In still further embodiments, a disposable compression sleeve attachment element could be provided that friction fit with both the internally-threaded nut 130 and a compression sleeve such as compression sleeve 340, or an embodiment in which a disposable compression sleeve attachment element is provided that friction fits with the internally-threaded nut 130 and threads into a compression sleeve such as compression sleeve 540 described above. In still other embodiments, disposable compression sleeve attachment elements could be provided that used split annular rings instead of threads on one or both ends of the disposable compression sleeve attachment element. It will be appreciated that numerous other disposable compression sleeve attachment element designs are possible that could be used to mount to the compression sleeve at the front end of the connector.

Figure 14:
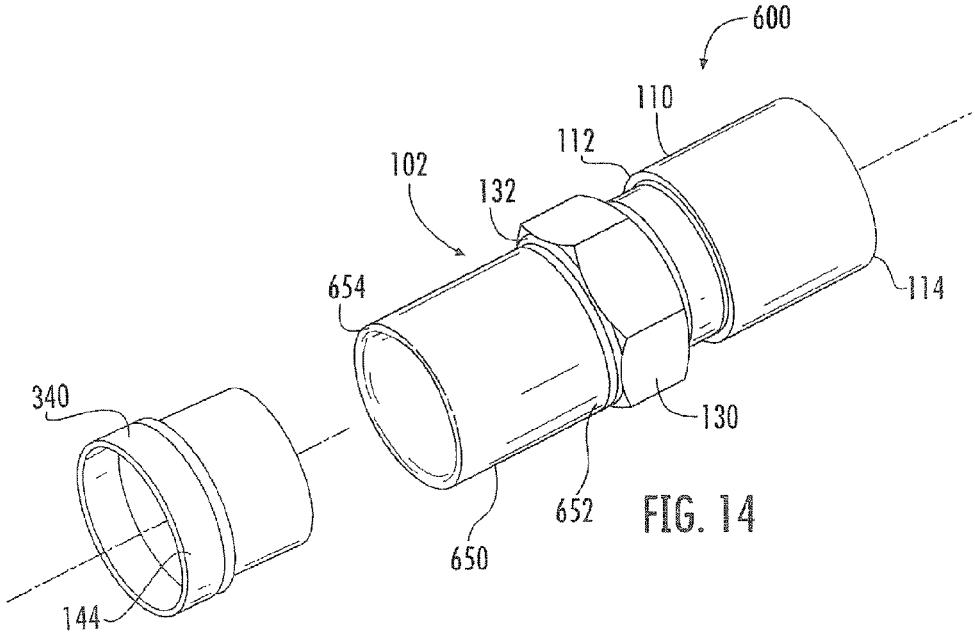
FIG. 14 is an exploded perspective view of a coaxial "F" connector according to yet additional embodiments of the present invention.

FIG. 14 is an exploded perspective view of an F-style coaxial connector 600 according to still further embodiments of the present invention. The connector 600 may include a connector body 110, an internal contact post 120 and an internally threaded nut 130, each of which may have the same configuration as the correspondingly numbered elements of the connector 100 described above with respect to FIGS. 2-9. The connector 600 further includes a compression sleeve 340 that may be identical to the compression sleeve 340 of FIG. 11. Additionally, the connector 600 further includes a port seal 650. As known to those of skill in the art, a port seal refers to a weather seal that may be placed over a male coaxial connector such as an F-style coaxial connector that has been mated with a female coaxial connector port. Typically, a weather seal comprises a hollow cylindrical element that is friction fit over at least the end of the female coaxial connector port and at least part of the internally threaded nut on the male coaxial connector. Port seals can provide significant protection against moisture and/or water migration into either or both the male or female components of a coaxial cable connection.

As shown in FIG. 14, a first end 652 of the port seal 650 may be pre-mounted at the factory on, for example, the lip 132 of the nut 130. The port seal 650 may be, for example, compression fit onto the lip 132 or permanently affixed to the lip 132 via, for example, an adhesive or other type of bond. A second end 654 of the port seal 650 extends beyond the outer edge of the lip 132. The compression sleeve 340 may be pre-inserted into the second end 654 of the port seal 650 at the factory, and may be maintained in that position via, for example, an interference fit. The port seal 650 may comprise, for example, a rubberized or plastic material having a tubular shape. The inner diameter of the port seal 650 may be smaller than the outer diameter of the lip 132 of nut 130 and may also be smaller than the outer diameter of at least one end of the compression sleeve 340. When an installer is ready to install the connector 600 onto the end of a coaxial cable 150, the installer may pull the compression sleeve 340 out of the port seal 650. The connector 600 may then be installed on the end of a coaxial cable 150 in the manner described above with respect to FIGS. 6-9.

Each of the embodiments of the present invention described above have been described with respect to an F-style coaxial connector that includes a compression sleeve that is configured to be seated inside the connector body. However, it will be appreciated that pursuant to further embodiments of the present invention, coaxial connectors having other kinds of compression sleeves are provided where the compression sleeve is pre-mounted at the factory at the front end of the connector.

Figure 15A:
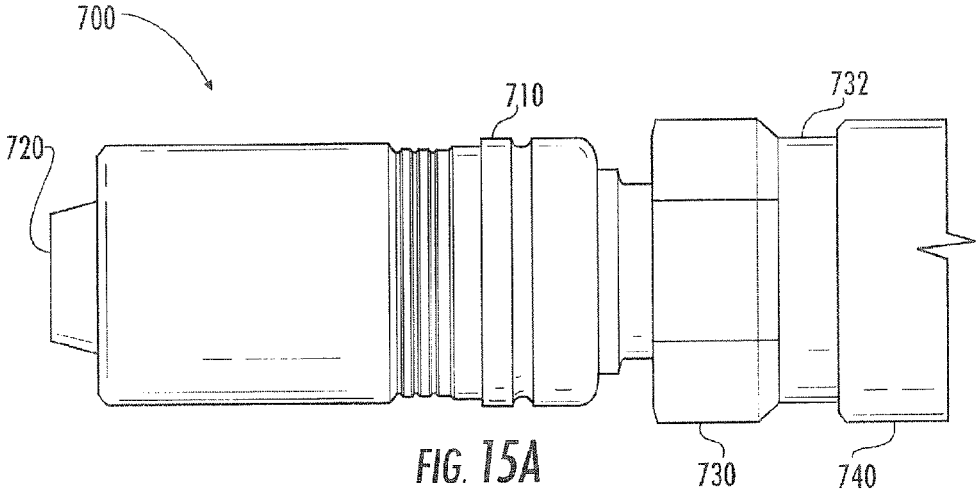
FIG. 15A is a perspective view of a coaxial "F" connector according to another embodiment of the present invention.
Figure 15B:
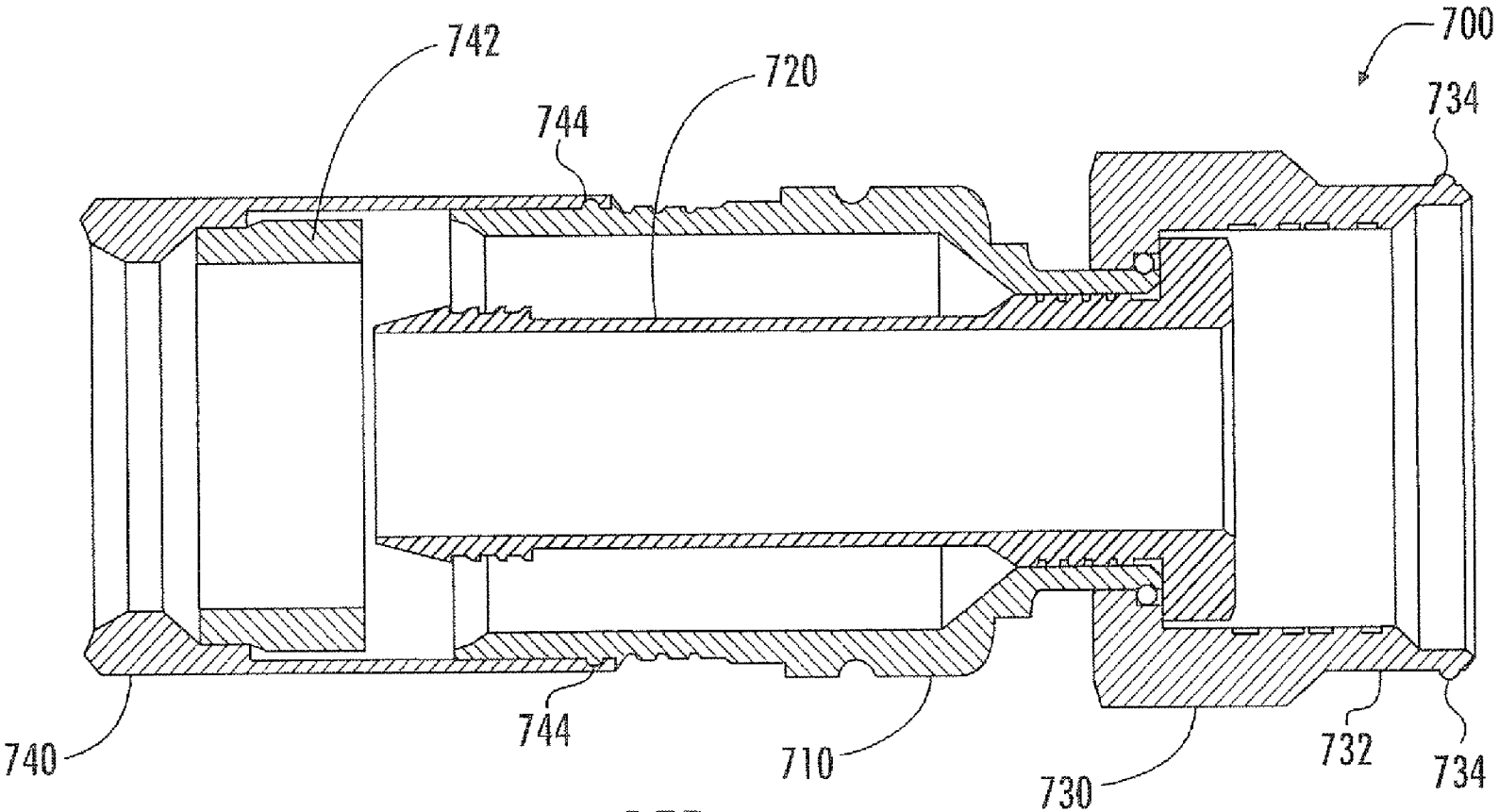
FIG. 15B is a longitudinal cross-sectional view of the coaxial "F" connector of FIG. 15A.

By way of example, FIGS. 15A and 15B are a perspective view and a cross-sectional diagram, respectively, of an F-style coaxial connector 700 according to further embodiments of the present invention. The perspective diagram of FIG. 15A shows the connector 700 in the configuration in which the connector would be shipped from the factory. The cross-sectional diagram of FIG. 15B illustrates the configuration that the connector 700 would be in when the compression sleeve thereof is inserted into the rear end of the connector to lock a coaxial cable (not shown) in place inside the connector.

As shown in FIGS. 15A and 15B, the connector 700 includes a tubular connector body 710, an inner contact post 720, an internally threaded nut 730 and a compression sleeve 740. The connector body 710 is shorter than the connector body 110 of connector 100. Moreover, as shown in FIG. 15B, the compression sleeve 740 fits over the outside surface of the connector body 710 when the compression sleeve is seated to lock a coaxial cable in place within the connector body 710. The compression sleeve 740 includes an annular internal element 742 that is designed to fit between the contact post 720 and the inside surface of the connector body 710 when the compression sleeve 740 is inserted axially into its seated position within the connector body 710. As a result, the annular internal element 742 may directly engage the shielding wires and/or jacket 24 of a coaxial cable 150 (not shown) that is inserted into and over the inner contact post 720 in the same manner that the main body of compression sleeve 110 of connector 100 engages a coaxial cable as is described above with reference to FIGS. 2-9. As such, similar to the connector 100, the connector 700 uses the annular internal element 742 portion of the compression sleeve 740 to directly impart a 360-degree circumferential compression on the inner contact post 720.

As shown in FIG. 15B, the inside diameter of the compression sleeve 740 may include one or more annular grooves 744. The exterior of the lip 732 on the internally-threaded nut 730 may include one or more annular ridges 734 that are configured to mate with the grooves 744 on the compression sleeve 740 in order to hold the compression sleeve 740 in place on the front end of the connector 700 when the connector is shipped from the factory in the configuration shown in FIG. 15A. These mating grooves 744 and ridges 734 may be designed to only apply a small retention force so that the compression sleeve 740 may readily be detached from the nut 730 by an installer when the installer is ready to terminate the connector 700 onto the end of a coaxial cable. It will be appreciated that other mechanisms could be used to releasably attach the external compression sleeve 740 to the nut 730 including, for example, threaded connections, split annular ring threaded connections, an adhesive bond, adhesive tape, shrink wrap or a variety of disposable compression sleeve attachment elements, as is discussed above with respect to the internal compression sleeve connectors depicted in FIGS. 2-14.

Figure 16A:
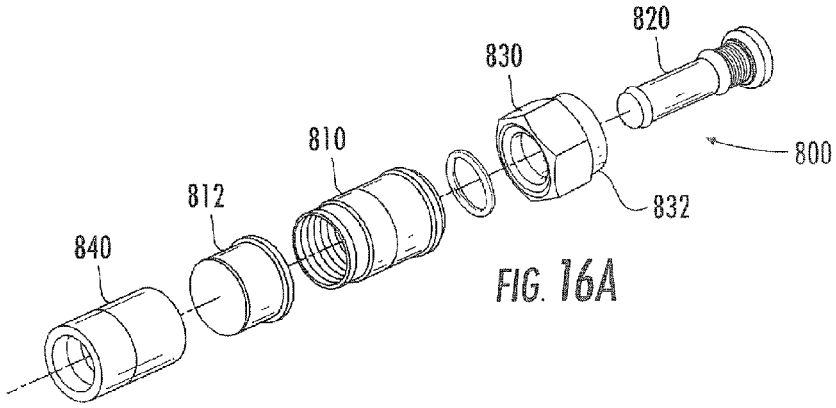
FIG. 16A is an exploded perspective view of a coaxial "F" connector according to still further embodiments of the present invention.
Figure 16B:
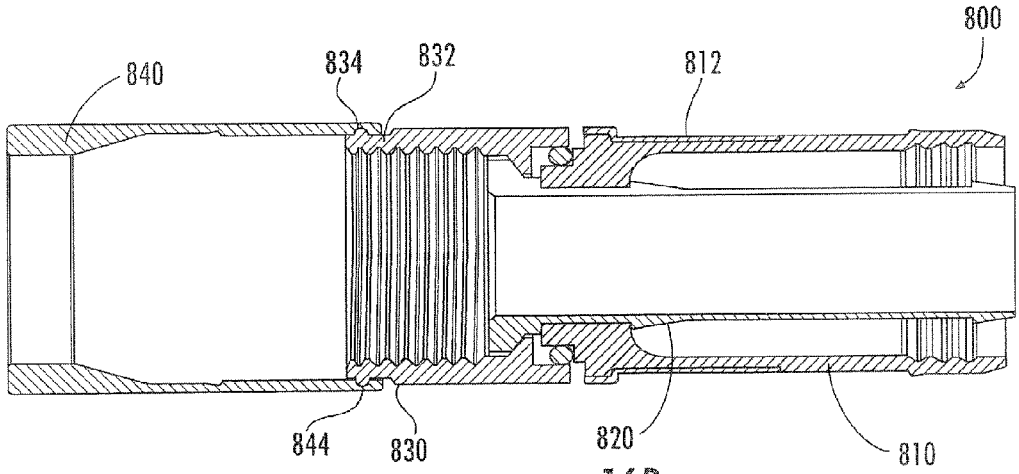
FIG. 16B is a longitudinal cross-sectional view of the coaxial "F" connector of FIG. 16A.

FIGS. 16A and 16B are an exploded perspective view and a longitudinal cross-sectional view, respectively, of an F-style coaxial connector 800 according to still further embodiments of the present invention that includes a tubular connector body 810, an inner contact post 820, an internally-threaded nut 830 and a compression sleeve 840. The cross-sectional diagram of FIG. 16B illustrates the configuration that the connector 800 would be in when shipped from the factory with the compression sleeve 840 mounted on the internally-threaded nut 830. As shown in FIGS. 16A and 16B, the connector 800 further includes a reinforcing shield 812 that fits over a portion of the connector body 800. The compression sleeve 840 fits over the outside diameter of the connector body 810. The outside radius of the connector body 810 may be, for example, the same size or slightly larger than the inside radius of a portion of the compression sleeve 840. A compression tool is used to force the compression sleeve 840 over the connector body 810, and in the process the connector body 810 deforms inwardly to assert a compression/retention force on the jacket and electrical shielding wires/tape of a coaxial cable 150 (not shown) that is inserted into and over the inner contact post 820. In this manner, the compression sleeve 840 is used to impart a 360-degree circumferential compression on the connector body 810 which, in turn, deforms to impart a circumferential compression on the outside components of the cable 150 and on the inner contact post 820.

As shown in FIG. 16B, the inside diameter of the compression sleeve 840 may include one or more annular grooves 844. The exterior of the lip 832 on the internally-threaded nut 830 may include one or more annular ridges 834 that are configured to mate with the grooves 844 on the compression sleeve 840 in order to hold the compression sleeve 840 in place on the front end of the connector 800 when the connector is shipped from the factory in the configuration shown in FIG. 16A. These mating grooves 844 and ridges 834 may be designed to only apply a small retention force so that the compression sleeve 840 may readily be detached from the nut 830 by an installer when the installer is ready to terminate the connector 800 onto the end of a coaxial cable. It will be appreciated that other mechanisms could be used to releasably attach the external compression sleeve 840 to the nut 830 including, for example, threaded connections, split annular ring threaded connections, an adhesive bond, adhesive tape, shrink wrap or a variety of disposable compression sleeve attachment elements, as is discussed above with respect to the internal compression sleeve connectors depicted in FIGS. 2-14.

Figure 17A:
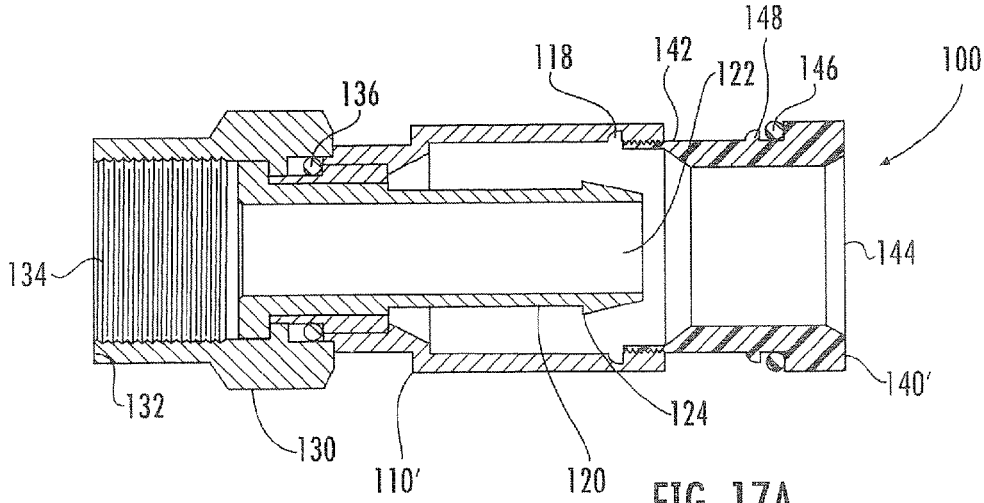
FIG. 17A is longitudinal cross-sectional view of a coaxial "F" connector according to yet further embodiments of the present invention.
Figure 17B:
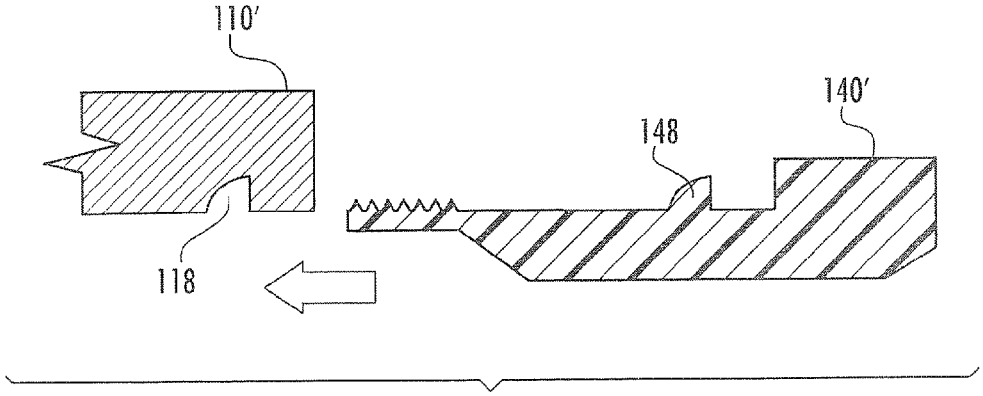
FIG. 17B is an enlarged view of a small portion of FIG. 17A that illustrates the respective cross-sectional shapes of an annular ring and a mating annular groove.

In each of the above-described embodiments of the present invention, the internal surface of the rear end of the connector bodies and the external surface of the compression sleeves may include mating structures that provide for snap-engagement of the compression sleeve and the connector body with which it mates. For example, each connector body could include grooves or recesses and the compression sleeves could include detents or other raised surfaces that mate with the grooves in order to hold the compression sleeve in place within the connector body. The mating recesses and raised surfaces may be designed to assist in locking the compression sleeve in place within its connector body once the compression sleeve is moved into its seated position. For example, FIG. 17A is a cross-sectional diagram of a modified version of the connector 100 of FIGS. 2-4 which includes a compression sleeve 140' that has an annular ridge 148 and a connector body 110' that includes an annular groove 118 along its inside diameter. As shown in FIG. 17B, a forward edge of the annular ridge 148 may have a curved or sloped surface, which facilitates insertion of the compression sleeve 140' into the rear end of the connector body 110'. However, the trailing edge of the annular ridge 148 is a vertical wall, which mates with the vertical trailing edge of the annular groove 118 when the compression sleeve 140' is fully seated within the connector body 110' and the annular ridge 148 mates with the annular groove 118. These facing vertical walls act to lock the compression sleeve 140' in place in the connector body 110' once the compression sleeve 140' is fully seated.

It will also be appreciated that, in other embodiments, the annular ridge may be provided on the inside body of the connector body and the annular groove may be provided on the compression sleeve. Furthermore, it will be appreciated that retention mechanisms other than mating annular ridges and grooves may be used. For example, raised projections may be provided on one of the compression sleeve or the inside diameter of the connector body that mate with recesses on the other of the compression sleeve or the inside diameter of the connector body. It will be appreciated that many other retention mechanisms may be used.

It will be appreciated that the connector bodies described herein may be any housing or body piece that receives an end of a coaxial cable that is to be attached to the connector. It will likewise be appreciated that the compression sleeves described herein may be implemented as any sleeve that is configured to be received within or over top of a connector body in order to directly or indirectly impart a generally circumferential compressive force on an end of a coaxial cable that is received within the connector body when the compression sleeve is moved to a seated position within the connector body. The inner contact posts described herein may be any post or other structure within the connector that receives the coaxial cable either within and/or on the post.

It will be appreciated that many modifications may be made to the exemplary embodiments of the present invention described above without departing from the scope of the present invention. By way of example, while the above-described connectors include separate connector bodies and inner contact posts, it will be appreciated that in other embodiments the connector body and inner contact post of a coaxial connector can be implemented together as a one-piece unit that performs the above-described functions of the connector body and inner contact post. Thus, the present invention encompasses both one and multi-piece designs. It will likewise be appreciated that other components of the coaxial connectors described above may be combined into a single piece (e.g., the internally threaded nut and the connector body could be combined) and/or that some of the components may be implemented as multi-part components (e.g., the connector body may comprise multiple parts).

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A coaxial connector, comprising:

a connector body having a front end and a rear end;

an inner contact post that is at least partly within the connector body;

an internally-threaded nut that is positioned at the front end of the connector body and that is connected to at least one of the connector body and the inner contact post, the internally threaded nut including a front lip; and a compression element that extends forwardly from the internally-threaded nut along a longitudinal axis of the coaxial connector such that the internally-threaded nut is between the connector body and the compression element, wherein an end of the compression element includes one or more threads, wherein the compression element is attached to the internally-threaded nut by releasably mounting the end of the compression element within an interior of the internally-threaded nut, by releasably mounting the end of the compression element onto an outside diameter of the front lip of the internally-threaded nut via a snap-engagement mechanism on the compression element and the front lip of the internally-threaded nut, or by releasably mounting the compression element to a port seal that is mounted to extend from the internally-threaded nut, and wherein the compression element is configured to be detached from the front lip of the internally-threaded nut and inserted into the rear end of the connector body to lock a coaxial cable in place inside the coaxial connector.

2. The coaxial connector of claim 1, wherein the internally-threaded nut is between the connector body and the compression element.

3. The coaxial connector of claim 2, wherein the compression element comprises a compression sleeve.

4. The coaxial connector of claim 3, wherein the end of the compression sleeve that includes the one or more threads includes at least one longitudinal groove.

5. The coaxial connector of claim 3, wherein the one or more threads comprises a single thread that forms an annular ring that is configured to form a snap connection with adjacent threads of the internally-threaded nut.

6. A method of installing a coaxial connector that has a front end and a rear end onto an end of a coaxial cable, the coaxial connector including a connector body, an inner contact post that is at least partly within the connector body, an internally-threaded rotatable nut that is attached adjacent the front end of the connector body, the internally threaded nut including a front lip, and a compression sleeve that extends forwardly from the internally-threaded rotatable nut along a longitudinal axis of the coaxial connector such that the internally-threaded rotatable nut is between the connector body and the compression sleeve, wherein an end of the compression sleeve includes one or more threads, wherein the compression sleeve is releasably attached to the internally-threaded rotatable nut by releasably mounting an end of the compression sleeve within an interior of the internally-threaded rotatable nut, by releasably mounting the end of the compression sleeve onto an outside diameter of the front lip of the internally-threaded rotatable nut via a snap-engagement mechanism on the compression sleeve and the front lip of the internally-threaded rotatable nut, or by releasably mounting the compression sleeve to a port seal that is mounted to extend from the internally-threaded rotatable nut the method comprising:

detaching the compression sleeve from the front end of the internally-threaded rotatable nut;

placing the compression sleeve over the end of the coaxial cable;

inserting the end of the coaxial cable into the rear end of the coaxial connector;

seating the compression sleeve within the connector body so as to impart a compressive force on the coaxial cable.

7. The method of claim 6, wherein the coaxial connector is delivered from a factory of manufacture with the compression sleeve directly mounted to the rotatable nut.

* * * * *